US005810927A

United States Patent [19]

Ayres et al.

[11] Patent Number: 5,810,927

[45] Date of Patent: Sep. 22, 1998

[54] INK TEMPERATURE CONTROL

[75] Inventors: John Ayres, Gale Gate House, Upper Dunsforth, Great Ouseburn, York YO5 9RU; Frank Ball, Bristol, both of United Kingdom

[73] Assignees: Frank Ball Limited, Wick; John Ayres, Great Ouseburn, both of United Kingdom

[21] Appl. No.: 589,623

[22] Filed: Jan. 22, 1996

[30] Foreign Application Priority Data

Jan. 23, 1995 [GB] United Kingdom ..... 9501272

[51] Int. Cl.[6] ..... B05C 11/00

[52] U.S. Cl. ..... 118/667; 118/58; 118/666; 118/712; 101/335; 101/350.1; 101/351.1; 101/352.01; 101/364; 400/198; 427/511

[58] Field of Search ..... 118/58, 666, 667, 118/712; 101/335, 350, 351, 352, 364; 400/198; 427/511

[56] References Cited

U.S. PATENT DOCUMENTS

| | | | |
|---|---|---|---|
| 3,813,516 | 5/1974 | Kudsi et al. . | |
| 4,341,156 | 7/1982 | Kaeppner . | |
| 4,693,179 | 9/1987 | Watts | 118/667 |
| 4,704,620 | 11/1987 | Ichihashi et al. | 118/667 |
| 4,753,165 | 6/1988 | Grosshauser . | |
| 5,046,420 | 9/1991 | Sondergold et al. | 101/350 |
| 5,168,811 | 12/1992 | Cox et al. . | |
| 5,272,971 | 12/1993 | Fredericks | 101/350 |
| 5,309,838 | 5/1994 | Kurz | 101/480 |
| 5,375,518 | 12/1994 | Kurz . | |
| 5,398,925 | 3/1995 | Zeltner | 271/276 |

FOREIGN PATENT DOCUMENTS

| | | |
|---|---|---|
| 1014725 | 8/1952 | France . |
| 851954 | 8/1952 | Germany . |

OTHER PUBLICATIONS

Baldwin product information entitled "Printing plate temperature control for wet and dry offset with combination unit", Jun. 1993.

*Primary Examiner*—Stanley S. Silverman
*Assistant Examiner*—Michael P. Colaianni
*Attorney, Agent, or Firm*—Emrich & Dithmar

[57] ABSTRACT

The temperature of ink applied to a substrate during printing is controlled by directing air of controlled temperature at the ink by means of an ink temperature controlling device (9). The device comprises a fan (11) and a heater (12) for heating the air propelled at the ink by the fan. The device may include a sensor (22) for monitoring the temperature of the ink in which case the sensor may be operably connected to the fan and/or heater to form a closed loop system.

6 Claims, 1 Drawing Sheet

INK TEMPERATURE CONTROL

IMPROVEMENTS IN OR RELATING TO PRINTING

Figure 1:
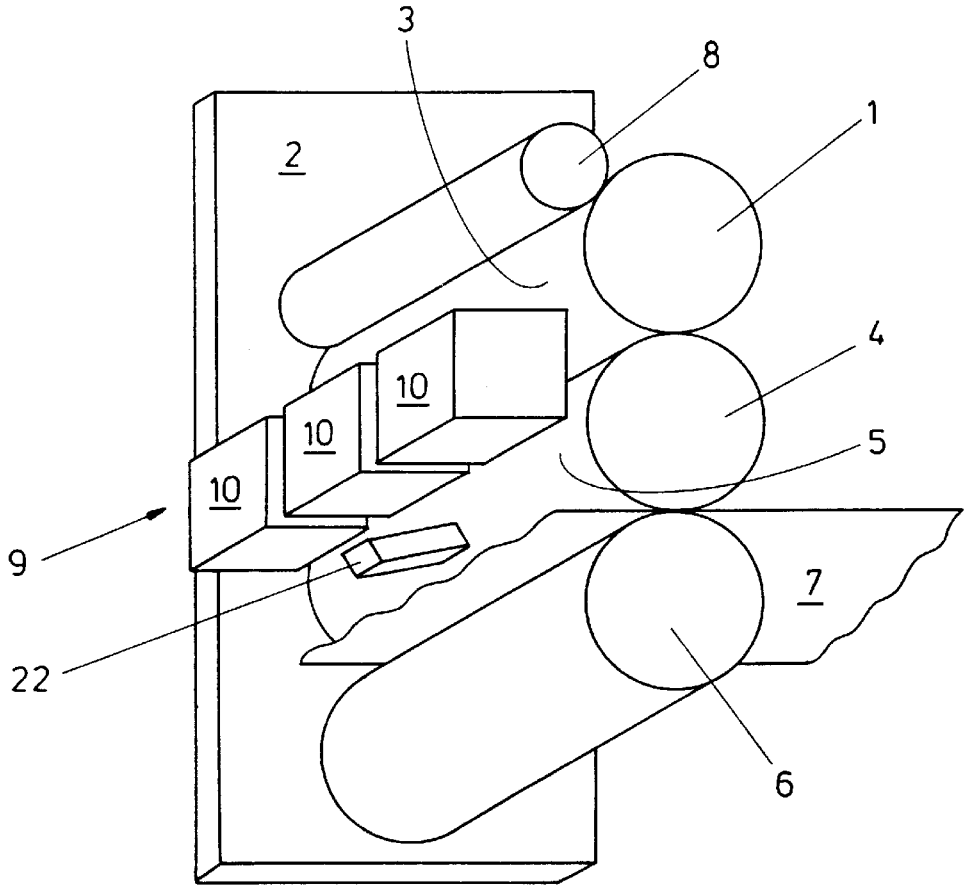

This invention relates to printing and is concerned with the control of ink temperature during printing.

Rotary printing presses are known to include a plate cylinder upon which is mounted a printing plate carrying a printing image. An inking system is provided to convey ink from an ink source to the plate cylinder whereby ink is applied to the printing image. The ink is then transferred from the printing image to the substrate to be printed, in the case of offset printing, via the intermediary of a resilient blanket. In offset lithographic printing processes, water is additionally applied to the printing plate. However, a dry offset printing process is known which has the advantage that the application of water is avoided. In order for dry offset printing to be successfully carried out, it is necessary to control the temperature of the ink.

Ordinarily, the inking system includes an inking train comprising several inking rollers with one or more inking rollers running in contact with the plate cylinder. It is known to control the temperature of the ink by circulating water through the central core of some of the inking rollers. However, this technique is not very responsive in that it takes a considerable time for the water passing through the inking roller to cause a variation in the temperature of the ink. Moreover, this technique merely controls the temperature of the ink on the inking roller whereas it is the temperature of the ink as it is being applied to the paper which needs to be regulated. Also, the requirement to conduct water through the inking roller to control the ink temperature introduces an additional cost which is disadvantageous.

It is an object of the present invention to provide a simple and cheap technique of accurately controlling the temperature of the ink at the time when it is about to be transferred from the printing plate to the substrate. Essentially, this is achieved by blowing air of controlled temperature directly at the ink.

Accordingly, one aspect of the present invention provides an ink temperature controlling device in, or for use in, a printing press comprising a plate cylinder, a printing plate mounted on the plate cylinder and having a printing image, and an inking roller for applying ink to the printing image for subsequent application to the substrate to be printed, characterised in that the ink temperature controlling device comprises a means of directing air of controlled temperature at the ink.

According to a second aspect of the present invention there is provided a method of controlling the temperature of ink during printing of a substrate which method comprises directing air of controlled temperature at the ink so that the ink applied to the substrate has a desired temperature.

In accordance with the invention, it is not necessary to make any specific provision for cooling the air emanating from the device although the temperature of the air may be somewhat less than ambient temperature as a consequence of its movement. Subject to this affect the air emanating from the device is at ambient temperature or elevated temperature and the temperature of the ink is controlled solely by the air emanating from the device. More particularly, no water or other liquid is circulated through an inking roller to adjust the temperature of the ink on the inking train.

Generally the ink temperature control device comprises a fan adapted to receive air from the atmosphere and propel it to the ink on the printing image and/or printing blanket and/or inking roller with the assistance of a suitable heater when necessary. Preferably the fan is of the axial type and the heater incorporates a heating element and a thermistor whereby the temperature of the heating element can be varied. Similarly, a means of varying the speed of the fan may also be provided. Preferably, the air being introduced into the fan is filtered so as to prevent dust contaminating the ink.

In accordance with a preferred embodiment, the temperature of the ink is monitored by, for example, an optical sensor. Then the temperature and/or volume of air being directed at the ink from the device can be manually controlled as desired in order to ensure that the ink is at a desired temperature. If desired, the sensor may be operably connected to the ink temperature control device to form a closed loop system whereby the temperature and/or speed of the air flow is automatically varied in dependence on the sensed temperature so that the ink temperature is kept at a desired temperature. Generally, it is preferred to maintain the air speed constant and to regulate the ink temperature by adjustment of the temperature of the air.

In a particularly preferred embodiment, the printing press is an offset press (either dry offset or offset lithographic) including a blanket cylinder and an impression cylinder so that ink is transferred from the printing plate to the blanket and hence to the substrate to be printed. In this case, the device is preferably located so as to direct the air at the vicinity of the nip between the plate cylinder and the blanket cylinder.

Depending upon the width of the press, the ink temperature control device may include more than one fan, heater and filter located transversely across the press. In this case, the temperature of the heaters and/or the speed of the fans may be controlled together but, if desired, each heater and/or fan may be individually controlled to provide different heating or cooling affects across the width of the press.

In the case of a multicolour printing press, including a plurality of printing units, each adapted to print ink of a different colour, each unit may be provided with one or more ink temperature controlling devices in accordance with the present invention. The device(s) of each printing unit will preferably be independently controllable so as to achieve an ink temperature appropriate to the nature of the ink being used at that unit.

In use, the device is located to direct heated air at the ink on, for example, the plate cylinder at start up until the ink reaches the desired temperature. Then, as printing commences, and heat is generated by the printing press, the heating element may be switched off so that the device merely directs air at ambient temperature onto the ink. In this way, an adequate control of temperature can generally be achieved.

Figure 2:
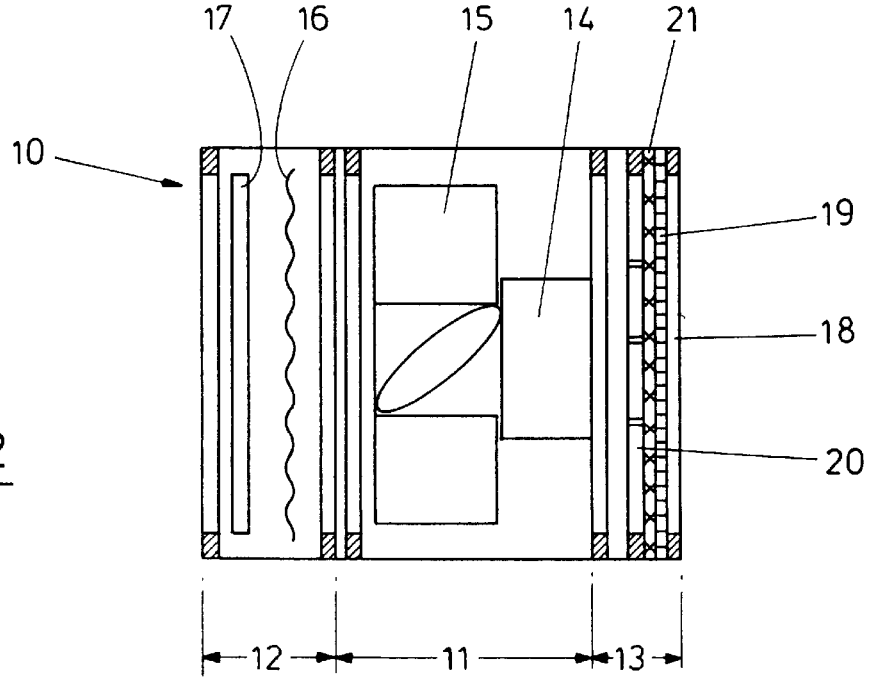

For a better understanding of the invention and to show how the same may be carried into effect, reference will now be made, by way of example, to the accompanying drawings, in which:

FIG. 1 is a diagrammatic view of a dry offset printing press incorporating an ink temperature control device in accordance with the invention, and FIG. 2 is a diagrammatic cross-section through the device shown in FIG. 1.

Referring to the drawings, there is shown a printing press comprising a plate cylinder 1 rotatably mounted in side frames (of which one only is shown and denoted by reference numeral 2). A printing plate 3 having a printing image (not shown) is fitted on the plate cylinder 1. The printing press also includes a blanket cylinder 4 carrying a resilient blanket 5 and similarly mounted for rotation in the side frames. The blanket cylinder 4 is positioned so as to form a nip with the plate cylinder 1. The press includes an impression cylinder 6 rotatably mounted in the side frames so as to form a nip with the blanket cylinder 4. The substrate 7 to be printed, e.g. a paper sheet, passes through the nip between the blanket cylinder 4 and the impression cylinder 6. Ink is applied to the printing image on the printing plate 3 by means of an inking roller 8 rotatably mounted in the side frames in contact with the plate cylinder so as to convey ink from a source (not shown) to the printing plate 3.

An ink-temperature control device 9 is mounted facing the printing plate and printing blanket nip and extends across the width of the printing press. The device 9 includes a plurality of modules 10 (three being shown in the drawing) each including a fan unit 11, a heater unit 12 and a filter unit 13 (see FIG. 2) arranged so that each fan unit 11 draws air into the device, through its associated filter unit 13, from the atmosphere and expels the air from the device via its associated heater unit 12. Each fan unit 11 includes an electric motor 14 driving fan blades 15. Typically it may be of the type supplied by Papst and available from RS Components Ltd under their stock No. 508-059. This is of all metal construction and is an axial 24V fan. Each heater unit 12 is controllable and includes a heating element 16 operably connected to a positive temperature coefficient element 17 whereby the output of the heating element may be regulated. Typically the heater unit may be of the type available from RS Components Ltd under their stock No. 224-565. Each filter unit 13 includes a suitable filter element and may be of the type available from RS Components Ltd under their stock No. 221-242. This comprises a cover 18, a mesh 19 and a finger guard 20 moulded in nylon resin and a filter pad 21 formed from polyester.

The heater units 12 are operably connected to an optical sensor 22 adapted to monitor the temperature of the ink on the blanket immediately before it contacts the substrate 7. The sensor 22 may, alternatively, be located so as to monitor the temperature of the ink on the printing plate.

In use, the fan and heater units are switched on so that air at elevated temperature is directed at the ink on the printing plate and blanket to heat it to such a temperature that the ink, which is about to be transferred to the substrate is at a desired temperature. Once the desired temperature is reached, the sensor 22 transmits a signal to the device so as to switch off the heater units 12. Should the temperature of the ink drop below the desired temperature, this is sensed by the sensor 22 and the heater units are switched on again. However, during the course of printing, heat is generated and it is not normally necessary to continue to supply heat to the ink from the heater units of the device. On the contrary, it is generally the case that the ink needs to be cooled so as not to exceed the desired temperature and this is effected by using the device to blow air at ambient temperature onto the ink.

The device of the invention can be readily fitted to new and existing printing presses at no great expense and is itself inexpensive to produce.

Although the printing press shown in the drawings is a dry offset press, the invention can be similarly applied to an offset lithographic printing press.

We claim:

1. A dry offset printing press comprising a plate cylinder, a printing plate mounted on the plate cylinder and having a printing image, an inking roller for applying ink to the printing image, a blanket cylinder and an impression cylinder so arranged that ink is transferred from the printing plate to the blanket cylinder and thence to a substrate to be printed, and an ink temperature controlling device including means of directing air at ambient or controlled elevated temperature at the ink in the vicinity of the nip between the plate cylinder and the blanket cylinder.

2. A press as claimed in claim 1 wherein said means of directing air comprises a fan adapted to receive air from the atmosphere and propel it towards the ink and a heater for heating the air, said heater incorporating a heating element and a thermistor whereby at least one of the temperature of the heating element and the speed of the fan may be varied.

3. A press as claimed in claim 2 which additionally includes a sensor to monitor the temperature of the ink, the sensor being operably connected to the heater to form a closed loop system whereby the temperature of the air flow is automatically varied in dependence on the sensed temperature so that the ink is kept at a desired temperature.

4. A dry offset printing press comprising a plate cylinder, a printing plate mounted on the plate cylinder and having a printing image, an inking roller for applying ink to the printing image, a blanket cylinder and an impression cylinder arranged so that ink is transferred from the printing plate to the blanket cylinder and thence to a substrate to be printed, and an ink temperature controlling device which includes a means of directing air at ambient or controlled elevated temperature at the ink on the blanket cylinder.

5. A press as claimed in claim 4, wherein said means of directing air comprises a fan adapted to receive air from the atmosphere and propel it towards the ink and a heater for heating the air, said heater incorporating a heating element and a thermistor whereby at least one of the temperature of the heating element and the speed of the fan may be varied.

6. A press as claimed in claim 5 which additionally includes a sensor to monitor the temperature of the ink, the sensor being operably connected to the heater to form a closed loop system whereby the temperature of the air flow is automatically varied in dependence on the sensed temperature so that the ink is kept at a desired temperature.

* * * * *